US011245226B2

(12) United States Patent
Yamane et al.

(10) Patent No.: US 11,245,226 B2
(45) Date of Patent: Feb. 8, 2022

(54) ELECTRICAL CONNECTOR WITH MATING INTERLOCK MEMBERS

(71) Applicant: Tyco Electronics Japan G.K., Kawasaki (JP)

(72) Inventors: Tomokazu Yamane, Kawasaki (JP); Seiji Komatsu, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/451,749

(22) Filed: Jun. 25, 2019

(65) Prior Publication Data

US 2019/0393649 A1 Dec. 26, 2019

(30) Foreign Application Priority Data

Jun. 26, 2018 (JP) ..... JP2018-120331

(51) Int. Cl.
*H01R 13/629* (2006.01)

(52) U.S. Cl.
CPC . *H01R 13/62938* (2013.01); *H01R 13/62933* (2013.01); *H01R 13/62977* (2013.01)

(58) Field of Classification Search
CPC ..... H01R 13/62938; H01R 13/62955; H01R 13/62933; H01R 13/62905
USPC ..... 439/157
See application file for complete search history.

(56) References Cited

U.S. PATENT DOCUMENTS

| | | | | |
|---|---|---|---|---|
| 6,755,673 | B2 | 6/2004 | Fukushima et al. | |
| 9,548,550 | B2 | 1/2017 | Tanaka | |
| 10,163,590 | B2 * | 12/2018 | Tabata | H01R 13/62938 |
| 2014/0364010 | A1 * | 12/2014 | Kuwahara | H01R 13/701 439/626 |

FOREIGN PATENT DOCUMENTS

JP 2002-343169 A 11/2002

OTHER PUBLICATIONS

Japanese Office Action, dated Jun. 2, 2020, 4 pages.

* cited by examiner

*Primary Examiner* — Renee S Luebke
*Assistant Examiner* — Paul D Baillargeon
(74) *Attorney, Agent, or Firm* — Barley Snyder

(57) ABSTRACT

An electrical connector comprises a first housing, a second housing, a lever adapted to couple the first housing and the second housing with each other, a first interlock member, a second interlock member, a first cam mechanism adapted to mate the first housing and the second housing with each other with movement of the lever in a first direction, and a second cam mechanism. The second interlock member is configured to be mated with the first interlock member to energize an electric circuit. The first cam mechanism limits a moving direction of the lever to a second direction after moving in the first direction. The second cam mechanism is adapted to convert the movement of the lever in the second direction into movement in a mating direction of the first housing and the second housing to mate the first interlock member with the second interlock member.

20 Claims, 13 Drawing Sheets

ELECTRICAL CONNECTOR WITH MATING INTERLOCK MEMBERS

CROSS-REFERENCE TO RELATED APPLICATION

This application claims the benefit of the filing date under 35 U.S.C. § 119(a)-(d) of Japanese Patent Application No. 2018-120331, filed on Jun. 26, 2018.

FIELD OF THE INVENTION

The present invention relates to an electrical connector and, more particularly, to an electrical connector capable of mating and unmating in a securely de-energized state.

BACKGROUND

In an electrical connector applied to a high-voltage and large-current electric circuit, it is necessary to perform mating and unmating of the connector in a securely de-energized state in order to prevent an operator from getting an electric shock. For this reason, a variety of electrical connectors have a mechanism for stopping energization upon mating and unmating of the connector.

Japanese Patent Application No. JP 2002-343169A, for example, discloses a power supply circuit breaking device where a connector mating detection terminal is provided separately from a power supply terminal and a power supply circuit is broken when the mating detection terminal is not connected. The power supply circuit breaking device of JP 2002-343169A is configured to disconnect the mating detection terminal by sliding a lever laterally in the device. Thereafter, by turning the lever, a connector housing is unmated and the power supply terminal is disconnected.

The power supply breaking device of JP 2002-343169A is provided with the mating detection terminal positioned in a lengthwise direction X crossing the mating direction of the connector housing. In JP 2002-343169A, because the mating detection terminal is mated in a lengthwise direction X, the mating detection terminal is displaced in the lengthwise direction X. Therefore, according to JP 2002-343169A, a dimension for positioning the mating detection terminal and a dimension for displacement of the mating detection terminal are required in the lengthwise direction X. If a space for an entire length of the mating detection terminal and a space for plugging and extraction of the terminal are secured in the lengthwise direction X, a lengthwise dimension of the device is consequently increased.

SUMMARY

An electrical connector comprises a first housing, a second housing, a lever adapted to couple the first housing and the second housing with each other, a first interlock member, a second interlock member, a first cam mechanism adapted to mate the first housing and the second housing with each other with movement of the lever in a first direction, and a second cam mechanism. The second interlock member is configured to be mated with the first interlock member to energize an electric circuit. The first cam mechanism limits a moving direction of the lever to a second direction after moving in the first direction. The second cam mechanism is adapted to convert the movement of the lever in the second direction into movement in a mating direction of the first housing and the second housing to mate the first interlock member with the second interlock member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
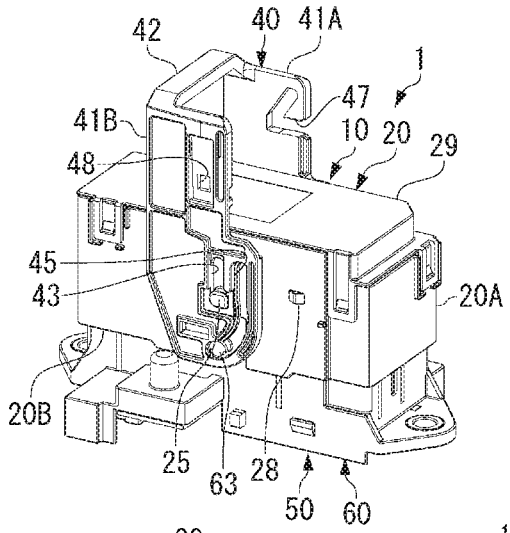
FIG. 1A is a perspective view of an electrical connector according to an embodiment in an unmated position.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A lengthwise direction X, a widthwise direction Y and a height direction Z of each element in this embodiment are defined as shown in the drawings. In this embodiment, an electrical connector 1 is positioned such that the height direction Z corresponds to a vertical direction and the widthwise direction Y corresponds to a horizontal direction.

Figure 2A:
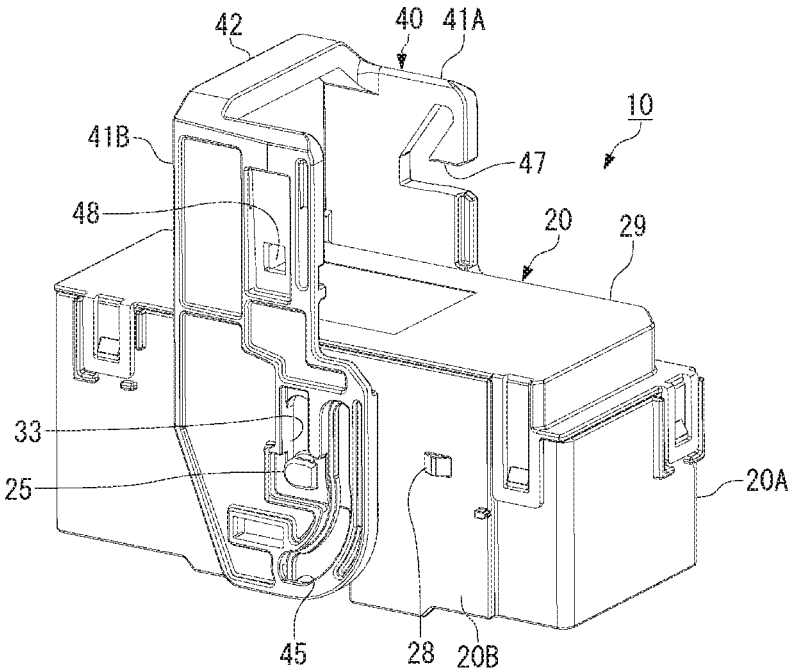
FIG. 2A is a perspective view of a lever assembly of the electrical connector.
Figure 2B:
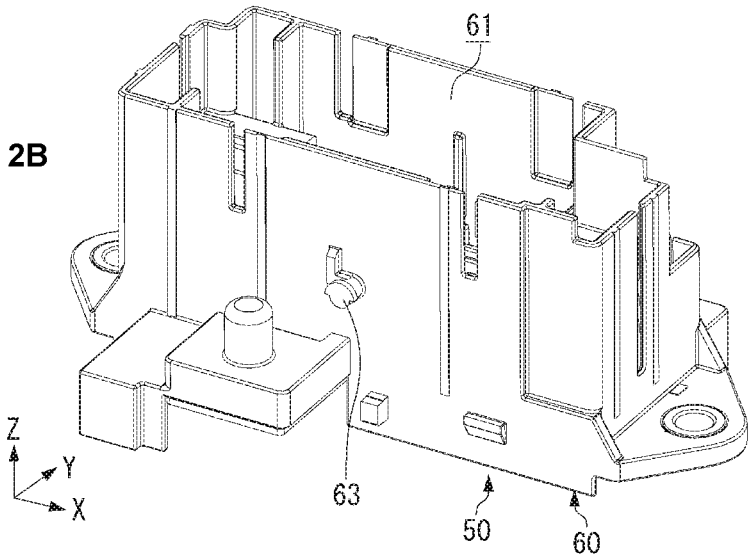
FIG. 2B is a perspective view of a cap assembly of the electrical connector.

An electrical connector 1 according to an embodiment replaceably accommodates, for example, an electric part used in a high-voltage and large-current electric circuit. As shown in FIGS. 2A and 2B, the electrical connector 1 comprises a lever assembly 10 and a cap assembly 50. The lever assembly 10 is formed so as to be capable of mating with the cap assembly 50.

Figure 3:
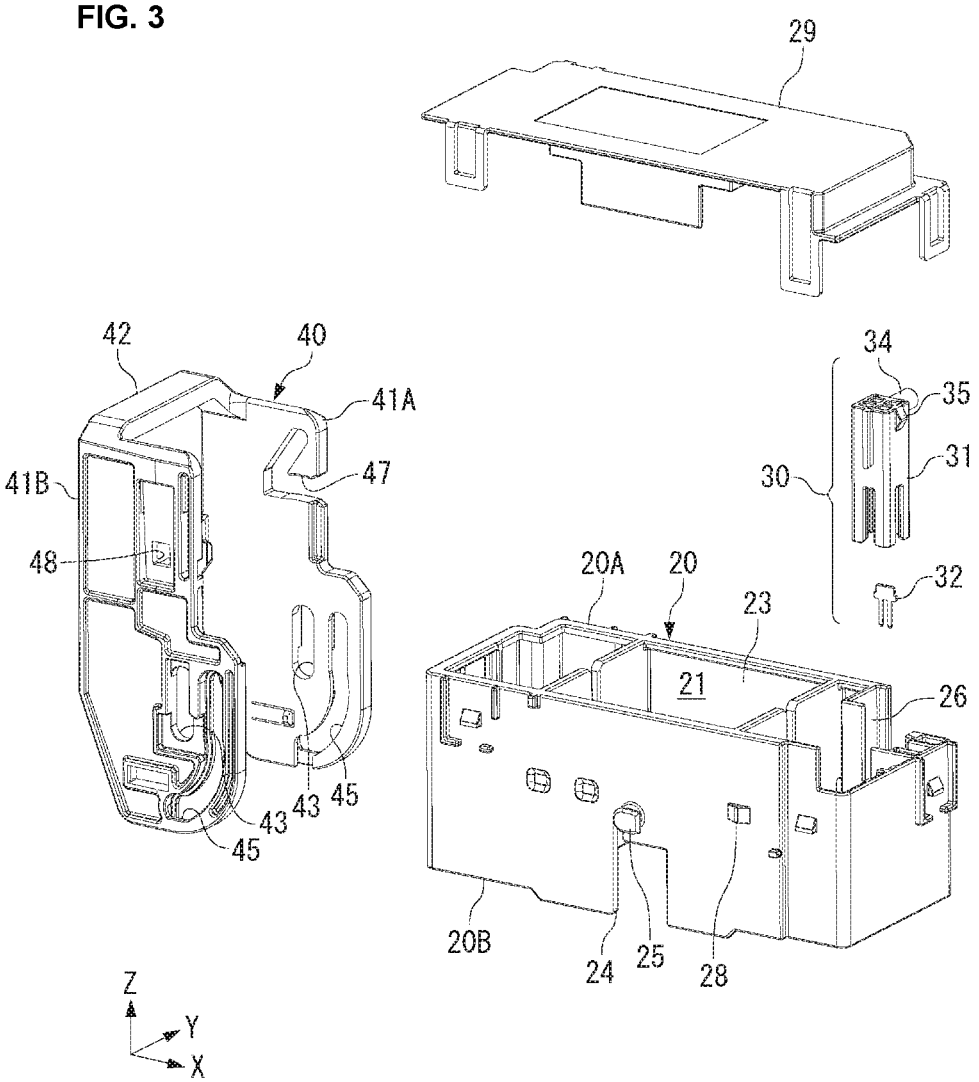
FIG. 3 is an exploded perspective view of the lever assembly.

As shown in FIGS. 2A and 3, the lever assembly 10 is provided with an outer housing 20, a cover 29, an interlock member 30, and a lever 40. The outer housing 20 is an example of a first housing. The interlock member 30 is an example of a first interlock member. In an embodiment, the outer housing 20 is integrally formed by injection-molding an electrically-insulating resin material. The cover 29, a housing portion 31 of the interlock member 30, and the lever 40 are also formed in a similar manner to the outer housing 20.

As shown in FIG. 3, the outer housing 20 has both ends in the height direction Z (both upper and lower sides in FIG. 3) opened, and has a first accommodation chamber 21 between upper and lower openings 23 and 24. An electric part connected to a power supply circuit is accommodated in the first accommodation chamber 21. The cover 29 is attached to an upper side of the outer housing 20, and, as shown in FIG. 2A, the opening 23 on the upper opening is covered with the cover 29.

When the lever assembly 10 and the cap assembly 50 are mated with each other, the first accommodation chamber 21 overlaps with a second accommodation chamber 61 provided in the cap assembly 50. Therefore, when the lever assembly 10 and the cap assembly 50 are in a mated state, the electric part is accommodated in the first accommodation chamber 21 and the second accommodation chamber 61 overlapping with each other.

Figure 6A:
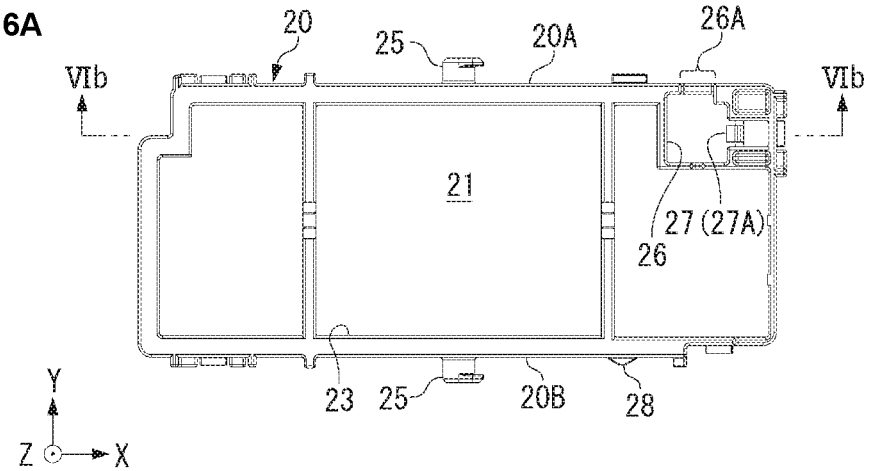
FIG. 6A is a top view of the outer housing.

As shown in FIG. 6A, the outer housing 20 has on both ends in the widthwise direction Y a pair of rotation shafts 25, 25 on which side bodies 41A, 41B of the lever 40 are rotatably supported. Inside the outer housing 20, a receiving portion 26 for retaining the interlock member 30 movably in the height direction Z is formed. As shown in FIG. 6A, the receiving portion 26 faces one side face 20A extending in the lengthwise direction X of the outer housing 20. The receiving portion 26 is formed in the vicinity of an end portion of the one side face 20A. A position of the receiving portion 26 and a position of the rotation shaft 25 are spaced away from each other in the lengthwise direction X.

Figure 6B:
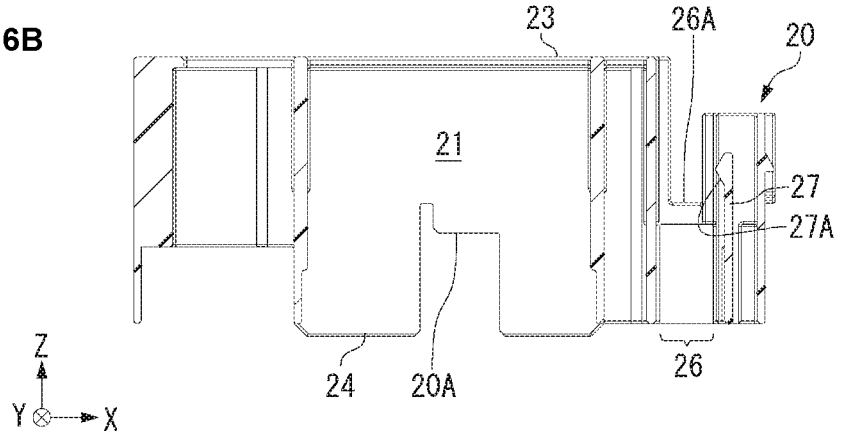
FIG. 6B is a sectional side view of the outer housing, taken along line VIb-VIb of FIG. 6A.

As shown in FIG. 6B, a cutout 26A extending in the height direction Z is formed at a position of the receiving portion 26 in the one side face 20A of the outer housing 20. A locating piece 27 for catching the interlock member 30 is formed inside the receiving portion 26. The locating piece 27 is an example of a locating member. The locating piece 27 is a cantilevered member formed integrally with the outer housing 20 and extending in the height direction Z. The locating piece 27 has a locating projection 27A at a distal end thereof.

As shown in FIGS. 2A and 3, a catching projection 28 is formed on the other side face 20B of the outer housing 20 in a position spaced away from the rotation shaft 25. The catching projection 28 is inserted into a catching hole 48 of the side body 41B when the lever 40 is in the mated position, thereby catching the lever 40.

Figure 4A:
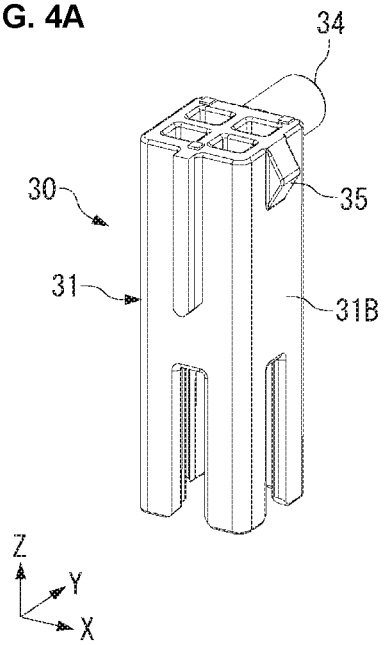
FIG. 4A is a perspective view of an interlock member.
Figure 4B:
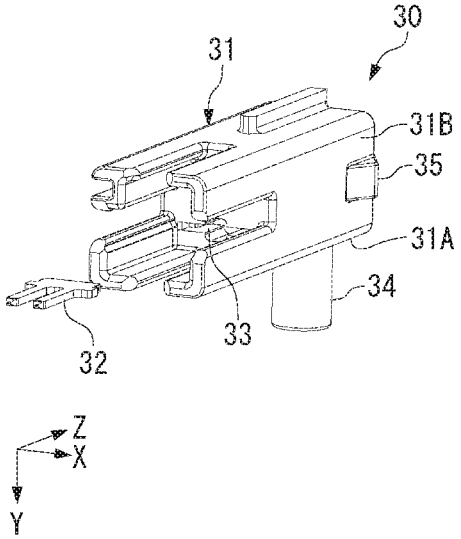
FIG. 4B is a bottom perspective view of the interlock member.
Figure 4C:
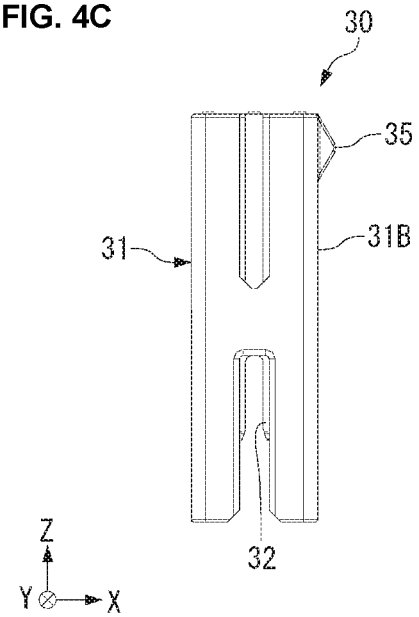
FIG. 4C is a front view of the interlock member.

As shown in FIGS. 3 and 4B, the interlock member 30 is a male connector having the housing portion 31 and a short-circuiting terminal 32 which is a male contact. The interlock member 30 functions as a portion of a switch for switching between an energized state of the electric circuit and a de-energized state thereof. The housing portion 31 is a rectangular rod-like body extending in the height direction Z, and has on a lower face side thereof a retaining portion 33 in which the short-circuiting terminal 32 is press-fitted. In an embodiment, the short-circuiting terminal 32 is made by stamping an electrically-conductive metal material, for example, a plate material made of a copper alloy.

Figure 4D:
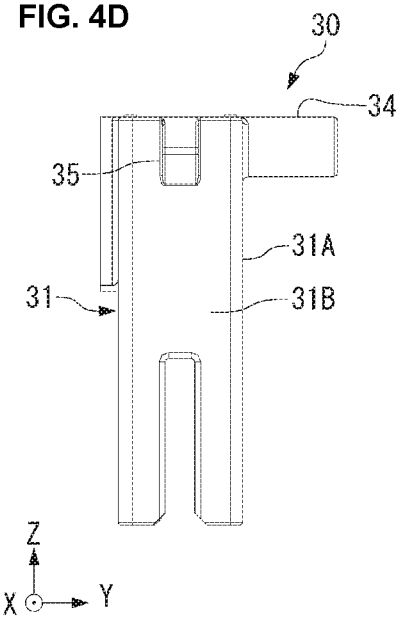
FIG. 4D is a side view of the interlock member.
Figure 5A:
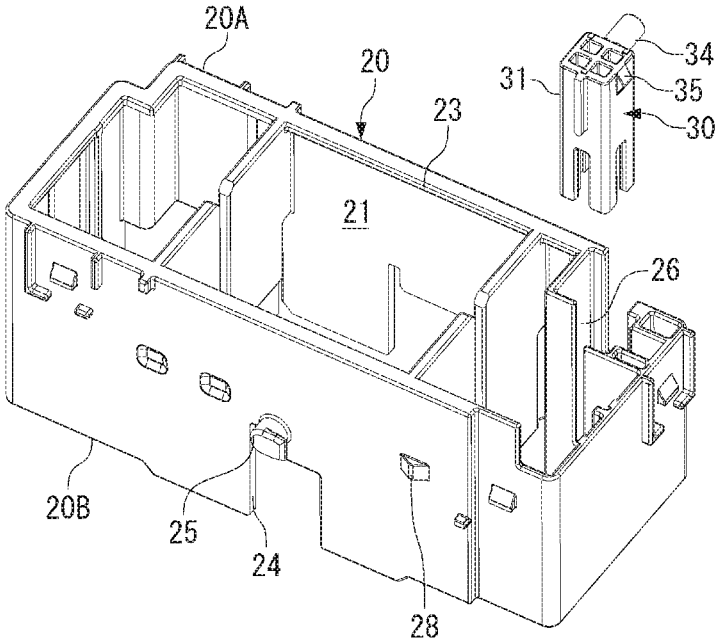
FIG. 5A is a perspective view of an outer housing of the lever assembly.
Figure 5B:
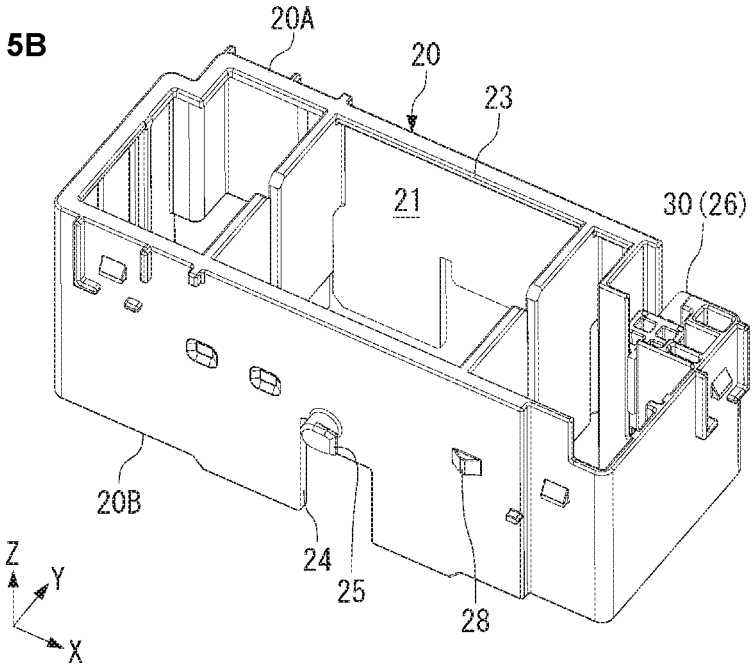
FIG. 5B is a perspective view of the outer housing of the lever assembly with an interlock member retained in the outer housing.

As shown in FIGS. 4B and 4D, a sliding boss 34 projecting in the widthwise direction Y is formed on a first side face 31A of the housing portion 31 on an upper end side in the height direction Z. The sliding boss 34 is an example of a second cam follower. The sliding boss 34 is positioned inside the cutout 26A shown in FIG. 6A when the interlock member 30 is retained in the receiving portion 26. At this time, the sliding boss 34 projects outside the outer housing 20 beyond the one side face 20A of the outer housing 20. Thereby, the sliding boss 34 can be inserted into a guide groove 47 described later provided in the lever 40. The sliding boss 34 and the guide groove 47 form a second cam mechanism.

Figure 6C:
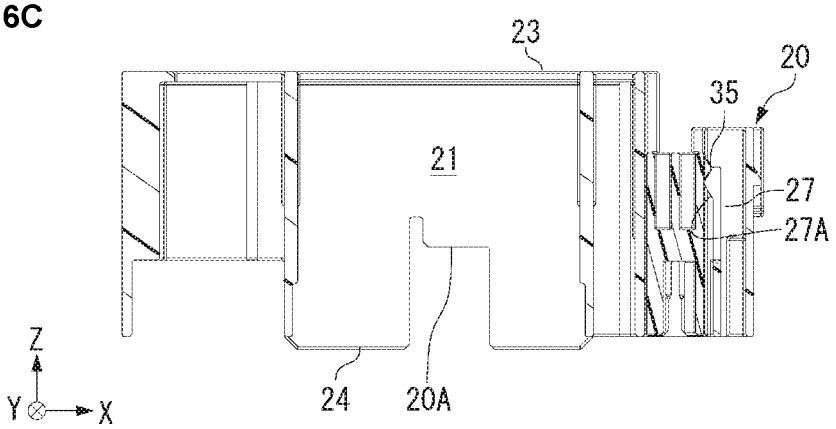
FIG. 6C is a sectional side view of the outer housing in a retaining state of the interlock member.

In the housing portion 31, as shown in FIG. 4A, a locating projection 35 is formed on a second side face 31B different from the first side face 31A. The locating projection 35 abuts on the locating projection 27A of the locating piece 27, as shown in FIG. 6C, when the interlock member 30 is retained in the receiving portion 26.

The lever 40 is a member configured to be operated by an external force, and is turnably and slidably attached to the outer housing 20. The lever 40 is capable of shifting around the rotation shafts 25, 25 from an unmated position shown in FIG. 1A to a circuit actuation position shown in FIG. 1C through a mated position shown in FIG. 1B.

Figure 7A:
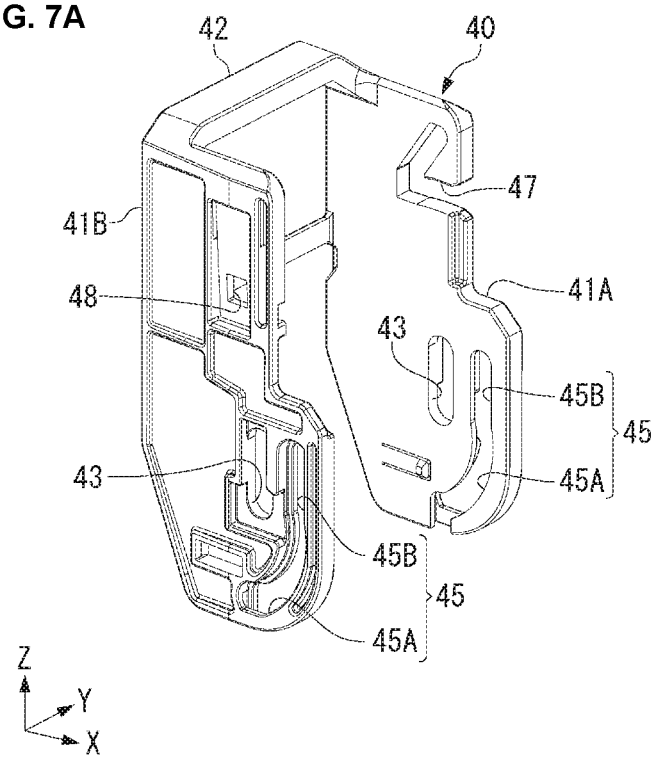
FIG. 7A is a perspective view of a lever of the lever assembly.

As shown in FIG. 7A, the lever 40 has the pair of side bodies 41A and 41B extending in parallel with each other and a coupling body 42 coupling the pair of side bodies 41A, 41B with each other. The pair of side bodies 41A, 41B are turnably supported on the outer housing 20 at one end sides thereof. The other ends of the pair of side bodies 41A, 41B are coupled with each other by the coupling body 42. Bearing holes 43, 43 into which the rotation shafts 25, 25 of the outer housing 20 are inserted are provided in the side bodies 41A and 41B, respectively. Further, a cam groove 45 into which a cam projection 63 provided on the cap housing 60 is inserted, is formed in each of the side bodies 41A, 41B. The cam groove 45 is an example of a first cam. Each cam groove 45 has a shape in which an arc-like first region 45A and a linear second region 45B are connected to each other. In another embodiment, the cam may be provided in the cap housing 60 and the cam projection 63 may be provided on the lever 40.

When the lever assembly 10 and the cap assembly 50 are mated with each other, the lever 40 is brought into the mated position by turning the lever 40 down from the unmated position to orient the same horizontally. In this action, the cam projection 63 moves within the first region 45A of the cam groove 45, so that the lever assembly 10 and the cap assembly 50 are mated with each other. Further, when the lever 40 is slid from the mated position in a horizontal direction, the lever 40 shifts to the circuit actuation position. When this action is performed, the cam projection 63 moves within the second region 45B of the cam groove 45.

Figure 7B:
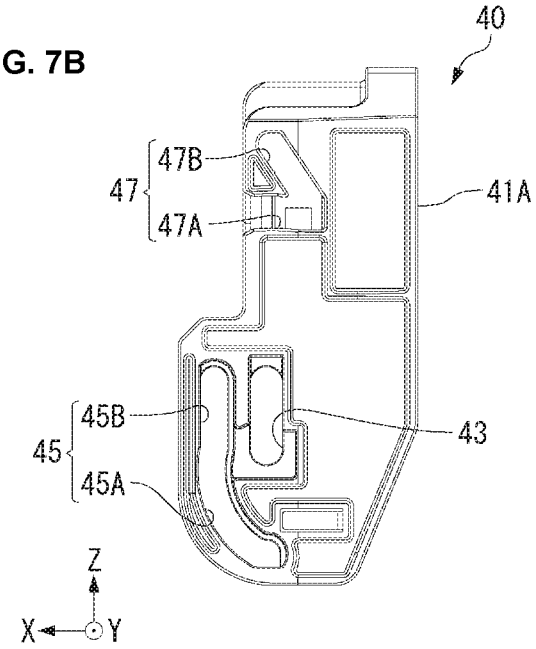
FIG. 7B is a rear view of the lever.

As shown in FIG. 7B, a guide groove 47 is formed in the side body 41A facing the one side face 20A of the outer housing 20. The guide groove 47 is an example of a second cam. When the lever assembly 10 and the cap assembly 50 are mated with each other, the sliding boss 34 of the interlock member 30 is inserted into the guide groove 47.

The guide groove 47 has a shape in which a first region 47A and a second region 47B, both of which are linear, are connected so as to be bent at an acute angle. One end of the first region 47A is opened so that the sliding boss 34 can be inserted into the first region 47A, and the other end of the first region 47A is connected to the second region 47B. The second region 47B is formed obliquely to the first region 47A.

The first region 47A functions as an inlet for receiving the sliding boss 34 when the lever 40 is turned from the unmated position. The second region 47B fulfills a function of pushing the interlock member 30 downward via the sliding boss 34 when the lever 40 is slid from the mated position to the circuit actuation position in a horizontal direction.

As shown in FIGS. 1 and 7A, a catching hole 48 is formed in the side body 41B facing the other side face 20B of the outer housing 20. When the lever 40 is in the circuit actuation position, the catching projection 28 is inserted into the catching hole 48, so that movement of the lever 40 is blocked.

Figure 8:
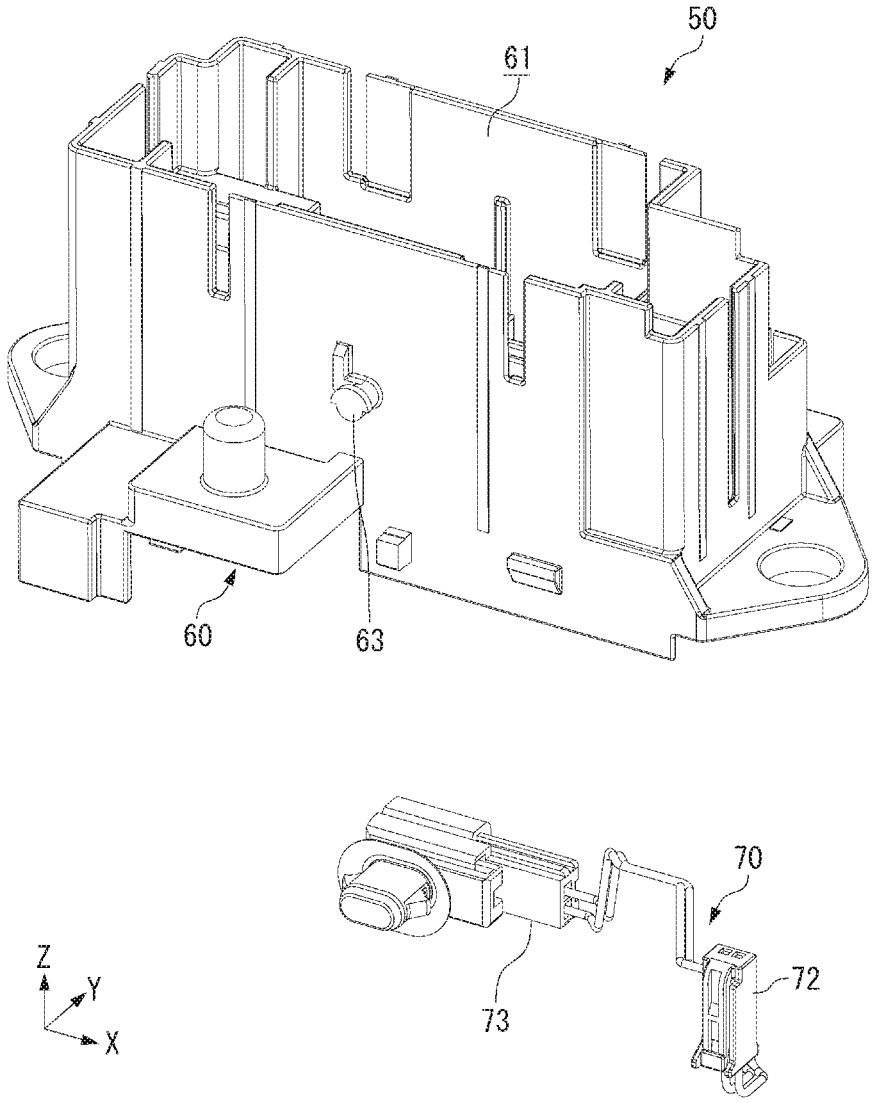
FIG. 8 is an exploded perspective view of the cap assembly.

As shown in FIGS. 2B and 8, the cap assembly 50 has a cap housing 60 and a mating interlocking member 70 configured to be mated with the interlock member 30. The cap housing 60 is an example of a second housing. The mating interlock member 70 is an example of a second interlock member. In an embodiment, the cap housing 60 is integrally formed by injection-molding an electrically-insulating resin material. A housing portion 72 of the mating interlocking member 70 is as formed in a similar manner to the cap housing 60.

As shown in FIG. 2B and FIG. 8, the cap housing 60 has a second accommodation chamber 61 having one side in the height direction Z (an upper side in FIG. 8) opened. In the cap housing 60, the other side in the height direction Z (a lower side in FIG. 8) thereof is partitioned by a bottom floor. A contact element electrically connected to the electric part accommodated within the outer housing 20 is accommodated inside the second accommodation chamber 61.

When the lever assembly 10 and the cap assembly 50 are mated with each other, the electric part is inserted into the contact element, and the electric part and the contact element are electrically connected to each other. At this time, the electric part and the contact element are accommodated in the first accommodation chamber 21 of the outer housing 20 and the second accommodation chamber overlapping with each other 61.

The cap housing 60, as shown in FIGS. 1A-1C and 2B, has the cam projections 63, 63 formed at both ends in the widthwise direction Y, which are inserted into the cam grooves 45 of the lever 40. The cam projection 63 is an example of a first cam follower. The cam grooves 45 and the cam projections 63, 63 form a first cam mechanism.

Figure 11A:
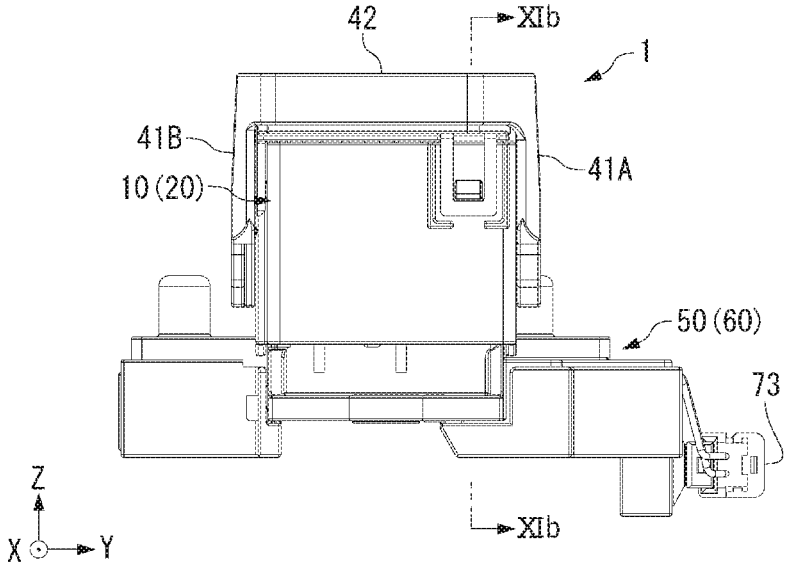
FIG. 11A is a side view of the electrical connector in the mated position.
Figure 11B:
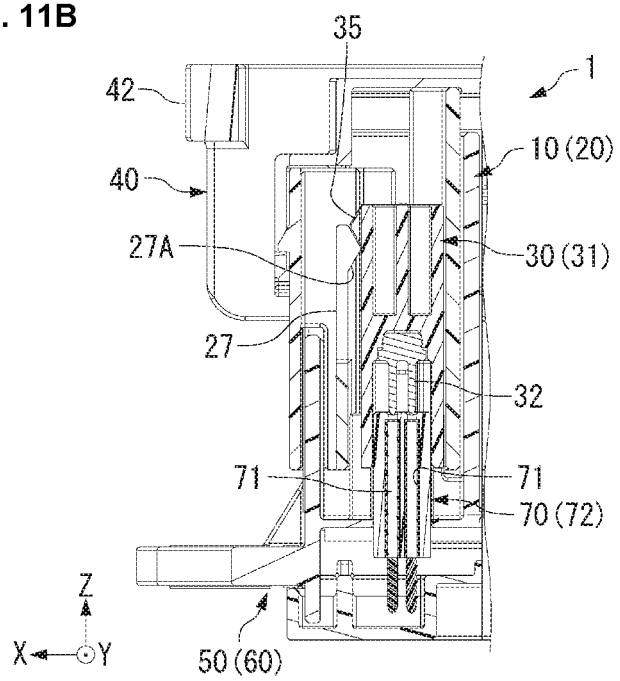
FIG. 11B is a sectional side view of the electrical connector in the mated position, taken along line XIb-XIb of FIG. 11A.

As shown in FIGS. 8 and 11B, the mating interlocking member 70 is a female connector having a cylindrical female contact 71 for receiving the short-circuiting terminal 32 and a housing portion 72 for retaining the female contact 71. The mating interlock member 70 mates with the interlock member 30 in an insertion direction which is the height direction Z. When the short-circuiting terminal 32 is electrically connected to the female contact 71, the electric circuit is in an energized state. When the short-circuiting terminal 32 is not electrically connected to the female contact 71, the electric circuit is in a de-energized state. In an embodiment, the female contact 71 is manufactured by forming an electrically-conductive metal material, for example, a plate material made of a copper alloy. The female contact 71 is connected with the electric circuit via a wire harness 73 shown in FIG. 8.

Next, a series of actions performed when the electrical connector 1 is shifted from the unmated position to the circuit actuation position through the mated position will be described in greater detail. These actions are performed when the electric circuit is actuated after the electric part is attached to the electrical connector 1.

Figure 1B:
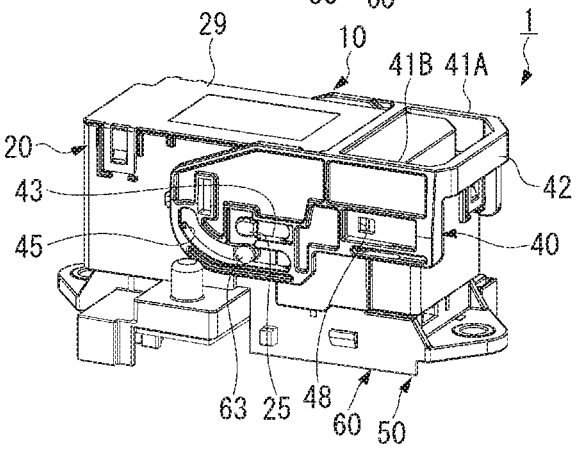
FIG. 1B is a perspective view of the electrical connector in a mated position.
Figure 9A:
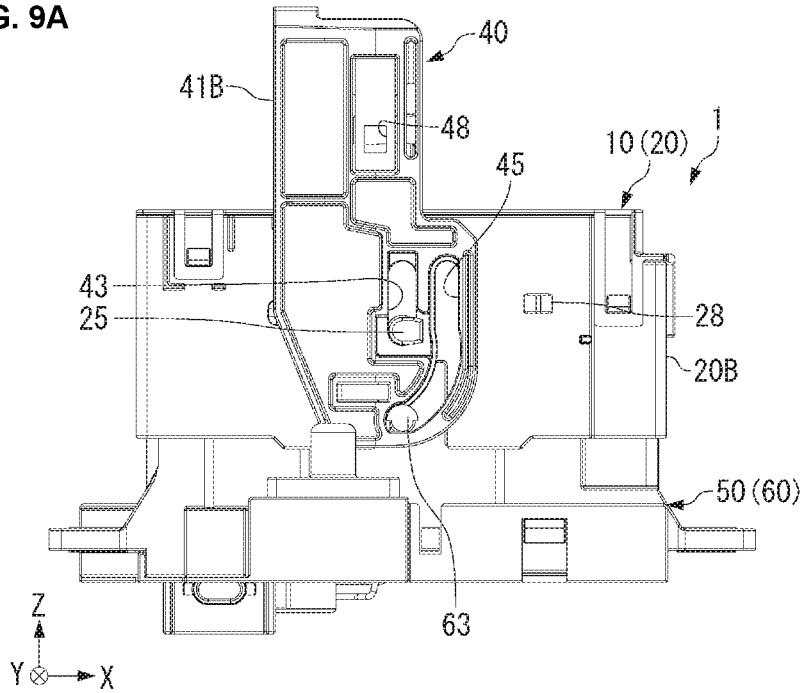
FIG. 9A is a front view of the electrical connector in the unmated position.
Figure 9B:
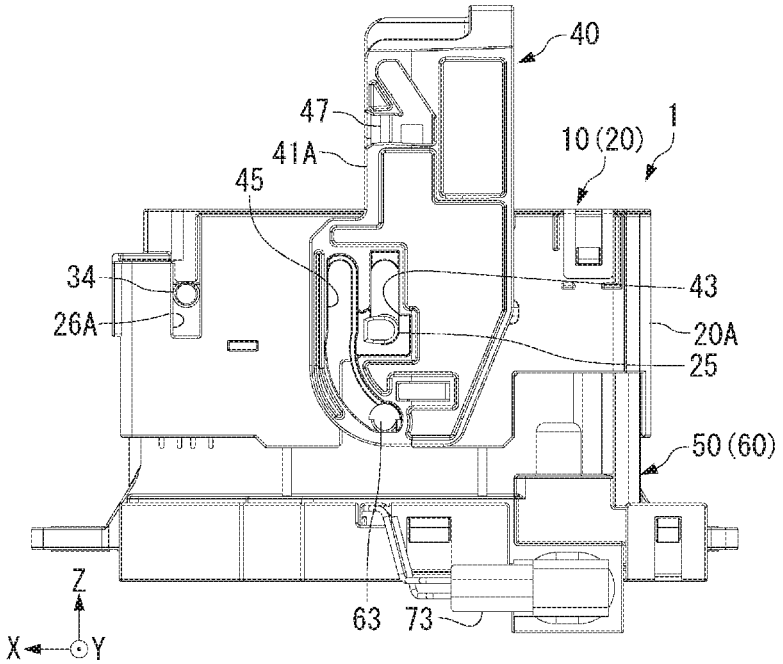
FIG. 9B is a rear view of the electrical connector in the unmated position.

As shown in FIGS. 1A and 9, in the unmated position, the lever assembly 10 and the cap assembly 50 are assembled in a state before mating. The unmated position is an example of a first position. At this time, the lever 40 is in a raised state along the height direction Z. The cam projection 63 in the unmated position is located at an end portion of the cam groove 45 within the first region 45A. In addition, as shown in FIG. 6C, the interlock member 30 in the unmated position is retained with the locating projection 35 abutting on the locating projection 27A of the locating piece 27. In this manner, the interlock member 30 is located within the receiving portion 26.

When the lever 40 is turned from the unmated position until the lever 40 is oriented horizontally (first action), the lever 40 shifts to the mated position shown in FIG. 1B, FIGS. 10A and 10B, and FIGS. 11A and 11B. The mated position is an example of a second position. The cam projection 63 in the mated position is located on a boundary between the first region 45A and the second region 45B of the cam groove 45.

A turning motion of the lever 40 from the unmated position to the mated position is converted into a downward linear motion of the lever assembly 10 by the cam projection 63 moving within the first region 45A of the cam groove 45. Therefore, the lever assembly 10 lowers from the unmated position, and thereby the lever assembly 10 and the cap assembly 50 are mated with each other in the mated position. At this time, the electric part is inserted into the contact element, and the electric part and the contact element are electrically connected to each other.

A distance from the rotation shaft 25 to an end portion of the lever 40 is larger than a distance between the rotation shaft 25 and the cam projection 63. Therefore, turning the lever 40 to mate the lever assembly 10 and the cap assembly 50 with each other is possible with small force according to the principle of leverage.

Figure 10A:
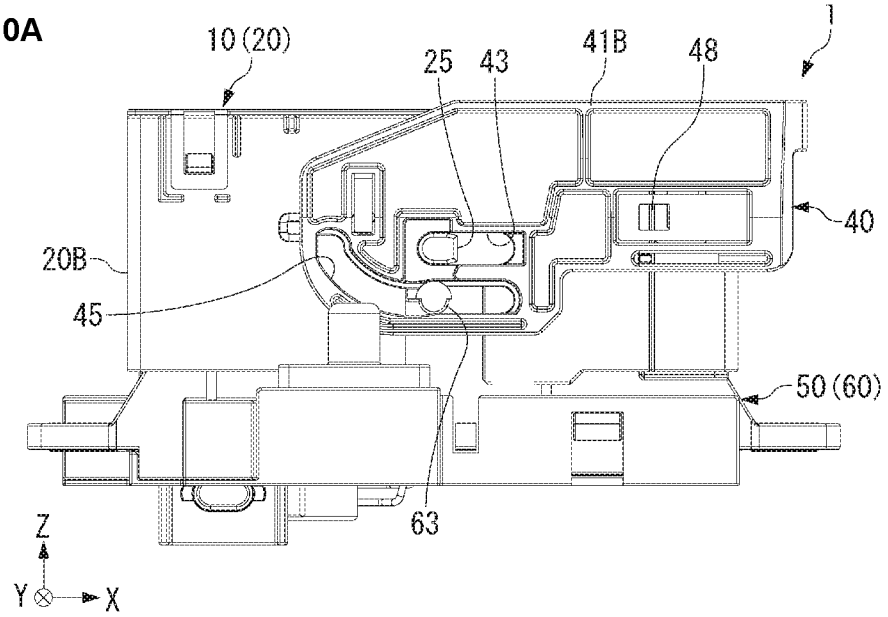
FIG. 10A is a front view of the electrical connector in the mated position.
Figure 10B:
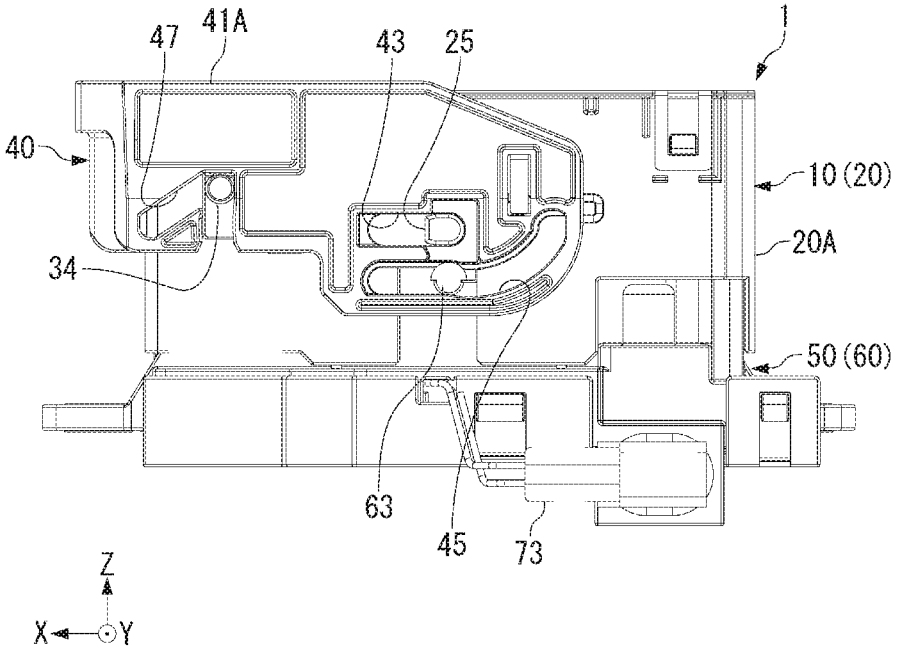
FIG. 10B is a rear view of the electrical connector in the mated position.
Figure 13A:
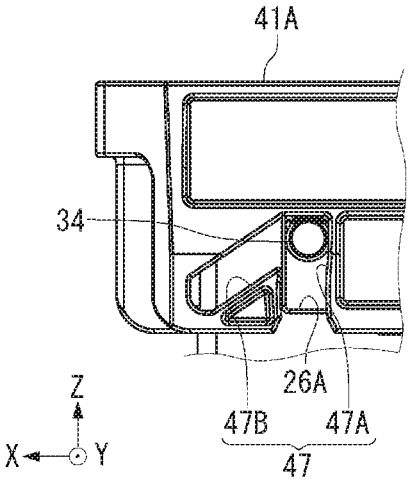
FIG. 13A is side view of an engagement state between a guide groove and a sliding boss in the mated position.

In the mated position, as shown in FIGS. 10B and 13A, the sliding boss 34 projecting from the one side face 20A is inserted into the guide groove 47 provided in the side body 41A of the lever 40. At this time, the sliding boss 34 is located at a boundary between the first region 47A and the second region 47B of the guide groove 47.

As shown in FIG. 11B, the interlock member 30 in the mated position is inserted into the mating interlock member 70 up to a position in which the short-circuiting terminal 32 and the female contact 71 are not in contact with the each other. The interlock member 30 in the mated position is retained with the locating projection 35 abutting on the locating projection 27A of the locating piece 27 in the same manner to the case shown in FIG. 6C. Thus, because the short-circuiting terminal 32 is not in contact with the female contact 71 in the mated position, the electric circuit is in a de-energized state.

Figure 1C:
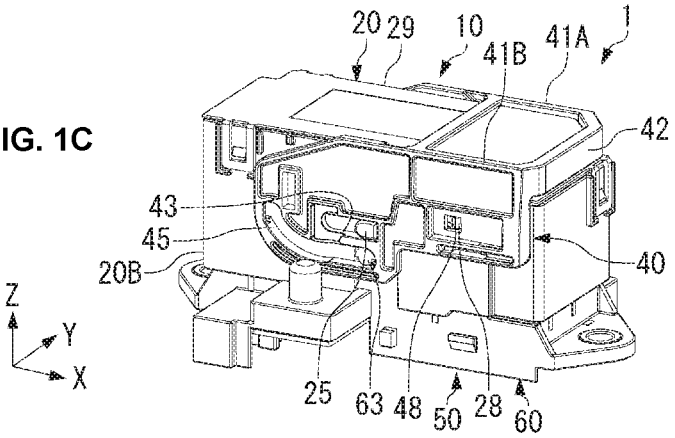
FIG. 1C is a perspective view of the electrical connector in a circuit actuation position.
Figure 12A:
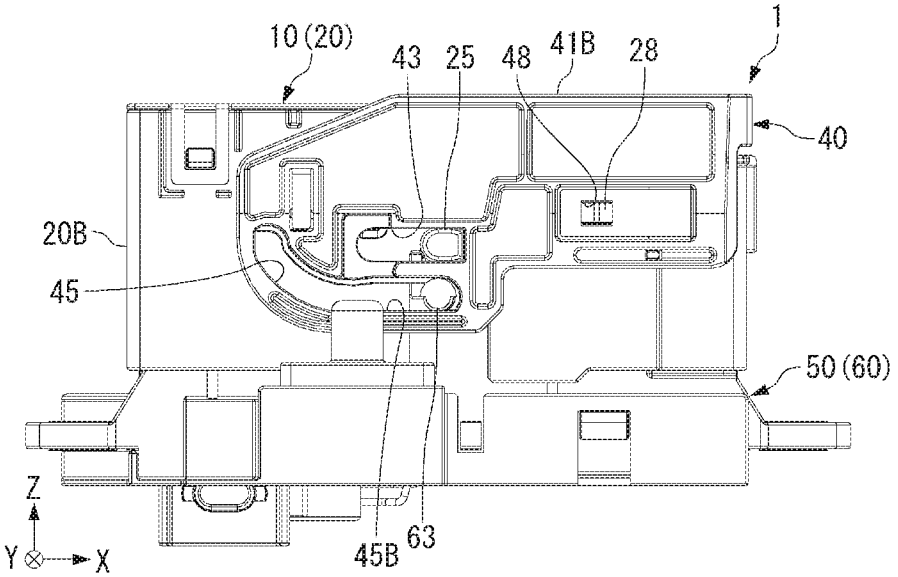
FIG. 12A is a front view of the electrical connector in the circuit actuation position.
Figure 12B:
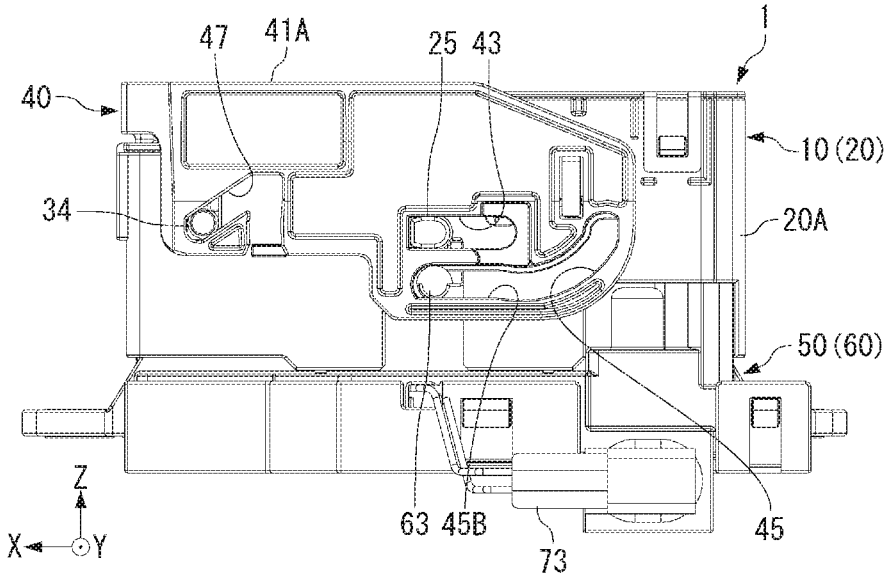
FIG. 12B is a rear view of the electrical connector in the circuit actuation position.

When the lever 40 is slid from the mated position in the horizontal direction, the lever 40 shifts to the circuit actuation position shown in FIG. 1C and FIGS. 12A and 12B. The circuit actuation position is an example of a third position. The cam projection 63 in the circuit actuation position is located at an end portion of the cam groove 45 within the second region 45B.

In the circuit actuation position, as shown in FIG. 1C and FIG. 12A, the catching projection 28 on the side face 20B is inserted into the catching hole 48 provided in the side body 41B of the lever 40. Thereby, movement of the lever 40 is blocked.

Figure 13B:
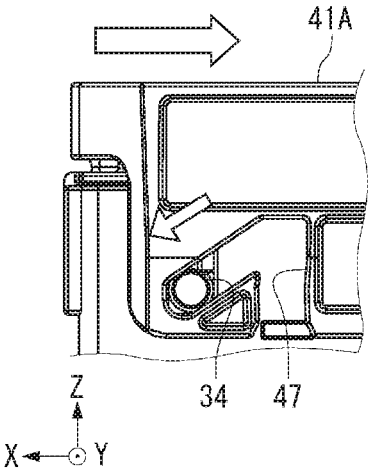
FIG. 13B is a side view of the engagement state between the guide groove and the sliding boss in the circuit actuation position.

When the lever 40 is slid from the mated position in the horizontal direction (second action), the sliding boss 34 inserted into the guide groove 47 of the side body 41A moves within the second region 47B of the guide groove 47. The interlock member 30 and the sliding boss 34 are constrained so as not to move in the lengthwise direction X by the receiving portion 26, but can move in the height direction Z. Therefore, as shown in FIG. 13B, the sliding boss 34 guided by the second region 47B is pushed downward along the cutout 26A.

Figure 13C:
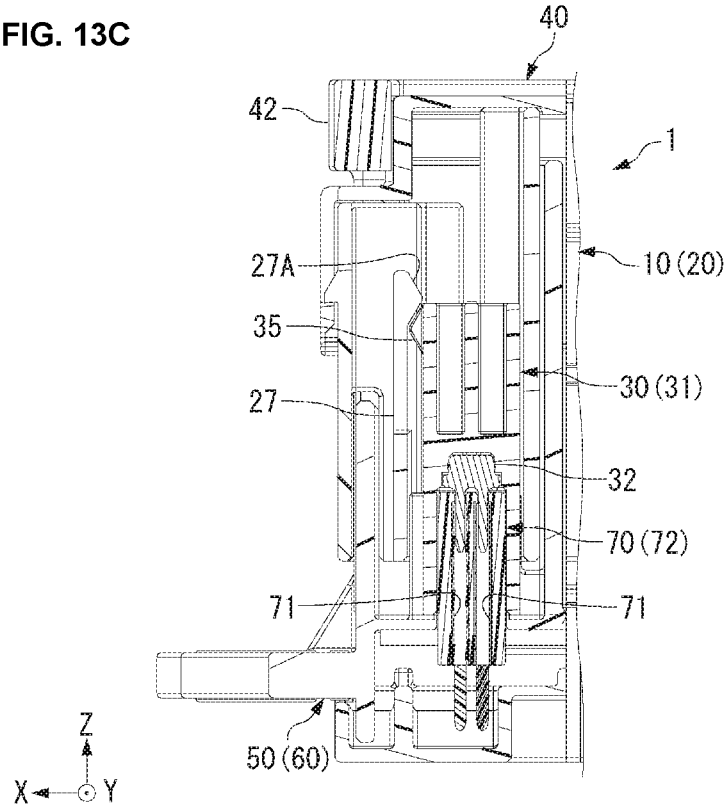
FIG. 13C is a sectional side view of a mated state between the interlock member and a meting interlock member in the circuit actuation position.

When the sliding boss 34 is pushed downward, the locating piece 27 is deflected outwardly in the lengthwise direction X, so that retainment of the locating projection 35 by the locating projection 27A is released. Thereby, as shown in FIG. 13C, the interlock member 30 is moved downwardly and is inserted into the mating interlock member 70, so that an electric connection between the short-circuiting terminal 32 and the female contact 71 is established. Because the short-circuiting terminal 32 and the female contact 71 are electrically connected to each other in the circuit actuation position in this manner, the electric circuit is in an energized state.

When the electric circuit is stopped and the electric part is detached from the electrical connector 1, it is only necessary to perform the actions from the unmated position up to the circuit actuation position reversely. Explanation of the actions performed in this case is omitted.

The lever assembly 10 and the cap assembly 50 are moved relatively to each other in the height direction Z to be mated with each other by turning of the lever 40 from the unmated position to the mated position. By mating of the lever assembly 10 and the cap assembly 50, the electric part is inserted into the contact element.

The interlock member 30 is moved linearly in the height direction Z to be mated with the mating interlock member 70 along the height direction Z. Therefore, the interlock member 30 is required to have a certain dimension in the height direction Z, but dimensions thereof in the lengthwise direction X and the widthwise direction Y enough to keep rigidity will suffice. In this manner, the interlock member 30 is not displaced in the lengthwise direction X, and a dimension thereof in the lengthwise direction X is also small, as described above. In addition, because a space for connecting the electric part and the contact element to each other is secured in the height direction Z of the electrical connector 1, it is easy to cover the dimension of the interlock member 30 in the height direction Z.

The lever 40 is moved in the lengthwise direction X in order to push down the sliding boss 34 by the guide groove 47. However, a space required for the lever 40 to move in the lengthwise direction X is sufficiently smaller than in the case of mating the interlock member 30 in the lengthwise direction X.

When the lever 40 is turned from the unmated position to the mated position, the cam projection 63 moves within the cam groove 45 of the lever 40, so that the lever assembly 10 and the cap assembly 50 are mated with each other. Then, a moving direction of the lever 40 is changed in the mated position and the lever 40 is horizontally moved to the circuit actuation position. Thereby, the sliding boss 34 is guided within the guide groove 47 of the lever 40, so that the interlock member 30 is mated with the mating interlock member 70.

The moving direction of the lever 40 is different between the first action for plugging/extracting the electric part and the second action for plugging/extracting the interlock member 30. Since the first action and the second action cannot be performed simultaneously, the lever assembly 10 and the cap assembly 50 are mated with the electric circuit securely de-energized when the first action is performed.

It is necessary to stop the lever 40 to change the moving direction in order to move the lever 40 from the unmated position to the circuit actuation position. In addition, the action of the lever 40 is stopped when the moving direction of the lever 40 is changed. Therefore, a time difference between plugging/extraction of the electric part and plugging/extraction of the interlock member 30 occurs inevitably. According to this embodiment, since it becomes easy to secure a discharging time of electric charges by the above time difference after breaking of the electric circuit, a risk of an operator getting an electric shock can be further reduced.

The interlock member 30 is moved by the cam mechanism composed of the sliding boss 34 and the guide groove 47. Thereby, a sliding amount of the lever 40 when the interlock member 30 is moved can be made small, and the interlock member 30 can also be easily inserted into the mating interlock member 70.

What is claimed is:

1. An electrical connector comprising:

a first housing adapted to accommodate an electric part;

a second housing configured to be mated with the first housing and adapted to accommodate the electric part together with the first housing;

a lever adapted to couple the first housing and the second housing with each other;

a first interlock member movably retained in the first housing by a resilient locating member of the first housing;

a second interlock member positioned in the second housing and configured to be mated with the first interlock member to energize an electric circuit connected with the electric part;

a first cam mechanism adapted to mate the first housing and the second housing with each other according to movement of the lever in a first direction, the first cam mechanism limiting a moving direction of the lever to a second direction different from the first direction after moving in the first direction; and a second cam mechanism adapted to convert the movement of the lever in the second direction into movement in a mating direction of the first housing and the second housing to mate the first interlock member with the second interlock member.

2. The electrical connector of claim 1, wherein the lever is movably supported on the first housing.

3. The electrical connector of claim 2, wherein the first cam mechanism has a first cam provided in the lever.

4. The electrical connector of claim 3, wherein the first cam mechanism has a first cam follower provided on the second housing and adapted to slide within the first cam.

5. The electrical connector of claim 2, wherein the second cam mechanism has a second cam provided in the lever.

6. The electrical connector of claim 5, wherein the second cam mechanism has a second cam follower provided on the first interlock member.

7. The electrical connector of claim 5, wherein the second cam follower is slidable within the second cam such that the first interlock member is adapted to slide along the second cam relative to the lever.

8. The electrical connector of claim 1, wherein the resilient locating member comprises a cantilevered member formed integrally with the first housing and extending in the height direction for catching the first interlock member.

9. The electrical connector of claim 8, wherein the first interlock member is retained in a stationary position in which the first interlock member is not mated with the second interlock member during movement of the lever in the first direction.

10. The electrical connector of claim 1, wherein the movement of the lever in the first direction is a tum from a first position to a second position of the lever.

11. The electrical connector of claim 10, wherein the movement in the second direction is a horizontal movement from the second position to a third position of the lever.

12. The electrical connector of claim 1, wherein the first interlock member is slidable relative to the lever as the lever is moved in the second direction.

13. The electrical connector of claim 1, wherein the first interlock member includes a locating projection defined on a side thereof for engaging with the resilient locating member of the first housing.

14. The electrical connector of claim 1, wherein the first housing defines an upper end open in a height direction and a lower end open in the height direction for enabling a visual indication of a state of the first interlock member and the second interlock member from either of the upper end or the lower end of the first housing.

15. An electrical connector comprising:

a first housing adapted to accommodate an electric part;

a second housing configured to be mated with the first housing and adapted to accommodate the electric part together with the first housing;

a lever adapted to couple the first housing and the second housing with each other;

a first interlock member movably retained in the first housing by a resilient locating member of the first housing;

a second interlock member positioned in the second housing and configured to be mated with the first interlock member to energize an electric circuit connected with the electric part;

a first cam mechanism adapted to mate the first housing and the second housing with each other according to movement of the lever in a first direction, the first cam mechanism limiting a moving direction of the lever to a second direction different from the first direction after moving in the first direction; and a second cam mechanism adapted to convert the movement of the lever in the second direction into movement in a mating direction of the first housing and the second housing to mate the first interlock member with the second interlock member, the second cam mechanism including a second cam formed on one of the lever or the first interlock member and a second cam follower formed on the other one of the lever or the first interlock member, wherein the second cam follower is inserted into the second cam when the first housing and the second housing are mated with each other.

16. An electrical connector comprising:

a first housing adapted to accommodate an electric part and defining an upper end open in a height direction, a lower end open in the height direction and an open accommodation chamber defined within an interior of the first housing and extending through the first housing in the height direction between the upper end and the lower end;

a second housing configured to be mated with the first housing and adapted to accommodate the electric part together with the first housing;

a lever adapted to couple the first housing and the second housing with each other;

a first interlock member movably retained in a receiving portion of the first housing distinct from the accommodation chamber;

a second interlock member positioned in the second housing and configured to be mated with the first interlock member to energize an electric circuit connected with the electric part, the upper open end and the lower open end of the first housing enabling a visual indication of a state of the first interlock member and the second interlock member;

a first cam mechanism adapted to mate the first housing and the second housing with each other in a mating direction according to movement of the lever in a first direction, the first cam mechanism limiting a moving direction of the lever to a second direction different from the first direction after moving in the first direction; and a second cam mechanism adapted to convert the movement of the lever in the second direction into movement of the first interlock member relative to the lever to mate the first interlock member with the second interlock member.

17. The electrical connector of claim 16, wherein the second cam mechanism is adapted to convert the movement of the lever in the second direction into movement of the first interlock member in the mating direction of the first housing and the second housing to mate the first interlock member with the second interlock member.

18. The electrical connector of claim 16, wherein the second cam mechanism includes a second cam provided in one of the lever or the first interlock member and a second cam follower provided on the other one of the lever or the first interlock member.

19. The electrical connector of claim 18, wherein the second cam follower is adapted to slide within the second cam.

20. The electrical connector of claim 19, wherein the second cam is provided in the lever and the second cam follower is provided on the first interlock member.

* * * * *